US005937842A

United States Patent [19]

Summers et al.

[11] Patent Number: 5,937,842

[45] Date of Patent: Aug. 17, 1999

[54] BOWSTRING RELEASES

[75] Inventors: Gregory E. Summers, 105 Overlink Ct., Lynchburg, Va. 24503; Randy Summers; Marc Rentz, both of Madison Heights, Va.

[73] Assignee: Gregory E. Summers, Lynchburg, Va.

[21] Appl. No.: 09/003,181

[22] Filed: Jan. 5, 1998

[51] Int. Cl.[6] ..... F41R 5/18

[52] U.S. Cl. ..... 124/35.2

[58] Field of Search ..... 124/35.2

[56] References Cited

U.S. PATENT DOCUMENTS

| | | | |
|---|---|---|---|
| 2,417,791 | 3/1947 | Tyszkiewicz . | |
| 2,488,597 | 11/1949 | Konold . | |
| 2,637,311 | 5/1953 | Rose . | |
| 2,819,707 | 1/1958 | Kayfes et al. . | |
| 2,905,166 | 9/1959 | Niemeyer . | |
| 2,965,093 | 12/1960 | Arsenault . | |
| 2,977,952 | 4/1961 | Gabriel et al. . | |
| 3,847,133 | 11/1974 | Awiszus . | |
| 4,086,904 | 5/1978 | Suski et al. | 124/90 |
| 4,134,369 | 1/1979 | Cook | 124/35.2 |
| 4,151,825 | 5/1979 | Cook | 124/35.2 |
| 4,173,210 | 11/1979 | Napier | 124/35.2 |
| 4,249,507 | 2/1981 | Marra | 124/35.2 |
| 4,282,851 | 8/1981 | Lyons | 124/35.2 |
| 4,509,497 | 4/1985 | Garvison | 124/35.2 |
| 4,539,968 | 9/1985 | Garvison | 124/35.2 |
| 4,620,523 | 11/1986 | Peck | 124/35.2 |
| 4,656,994 | 4/1987 | Jenks . | |
| 4,674,469 | 6/1987 | Peck | 124/35.2 |
| 4,691,638 | 9/1987 | Peck | 124/35.2 |
| 4,722,319 | 2/1988 | Brady | 124/35.2 |
| 4,791,908 | 12/1988 | Pellis | 124/35.2 |
| 4,881,516 | 11/1989 | Peck | 124/35.2 |
| 4,909,233 | 3/1990 | Stephenson | 124/91 |
| 4,926,835 | 5/1990 | Peck | 124/35.2 |
| 4,981,128 | 1/1991 | Garvison | 124/35.2 |
| 5,016,603 | 5/1991 | Tentler | 124/91 |
| 5,020,508 | 6/1991 | Greene, Jr. | 124/35.2 |
| 5,027,786 | 7/1991 | Peck | 124/35.2 |
| 5,031,600 | 7/1991 | Moore | 124/35.2 |
| 5,070,854 | 12/1991 | Peck | 124/35.2 |
| 5,076,251 | 12/1991 | Peck | 124/35.2 |
| 5,078,116 | 1/1992 | Peck | 124/35.2 |
| 5,103,796 | 4/1992 | Peck | 124/35.2 |
| 5,170,771 | 12/1992 | Peck | 124/35.2 |
| 5,170,772 | 12/1992 | Hamm | 124/35.2 |
| 5,247,921 | 9/1993 | Todd | 124/35.2 |
| 5,263,466 | 11/1993 | Peck | 124/35.2 |
| 5,318,004 | 6/1994 | Peck | 124/35.2 |
| 5,359,983 | 11/1994 | Peck | 124/35.2 |
| 5,361,747 | 11/1994 | Laabs | 124/91 |
| 5,370,102 | 12/1994 | Peck | 124/35.2 |
| 5,680,851 | 10/1997 | Summers | 124/35.2 |
| 5,685,286 | 11/1997 | Summers | 124/35.2 |

*Primary Examiner*—John A. Ricci
*Attorney, Agent, or Firm*—Nixon & Vanderhye P.C.

[57] ABSTRACT

A bowstring release includes a handle body, the handle body supporting a jaw release housing and associated jaws actuable by means of a firing pin extending into an interior portion of the handle body; a hammer bar including a hammer head engagable with the firing pin and movable to a cocked position by means of a cocking trigger portion of the hammer bar, the cocking trigger extending outside the candle body; a firing trigger assembly including a firing trigger outside the handle body and a trigger actuating arm located within the handle body; and a roller sear housing and roller sear assembly, the housing having one end engageable with the trigger actuating arm, and the roller engageable with the hammer head, the hammer head is seated in the roller sear housing in a cocked position, such that pressure applied to the firing trigger causes the roller sear housing to release the hammer head for firing engagement with the firing pin.

30 Claims, 16 Drawing Sheets

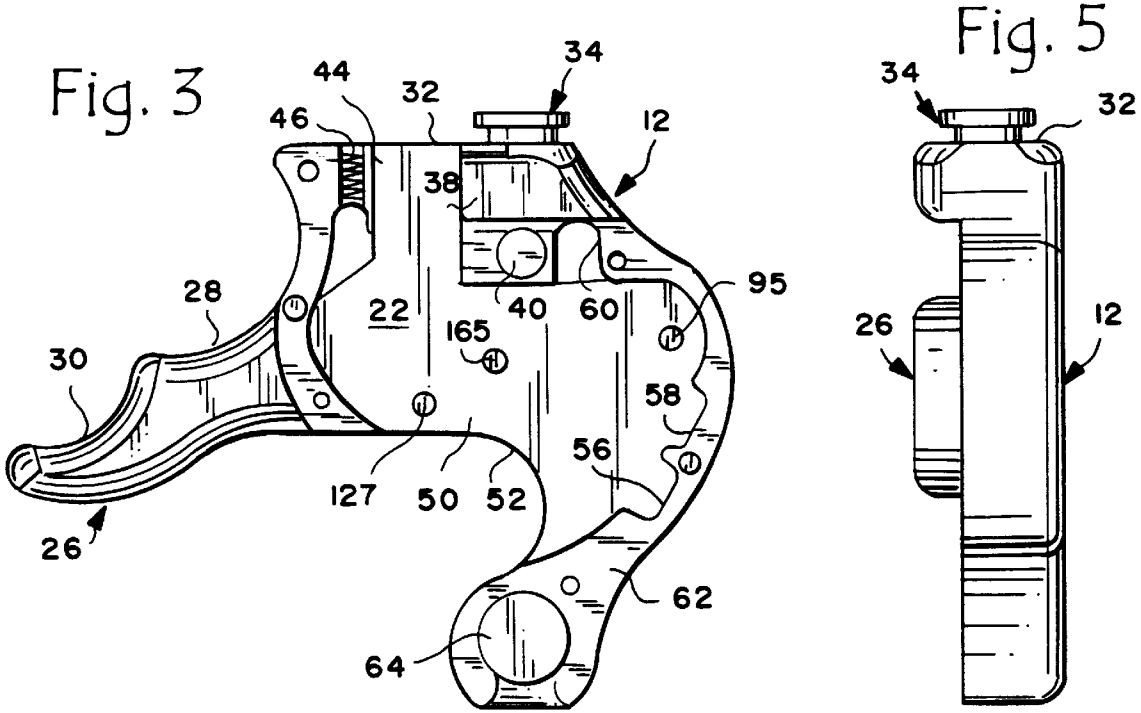
Fig. 3
Fig. 5
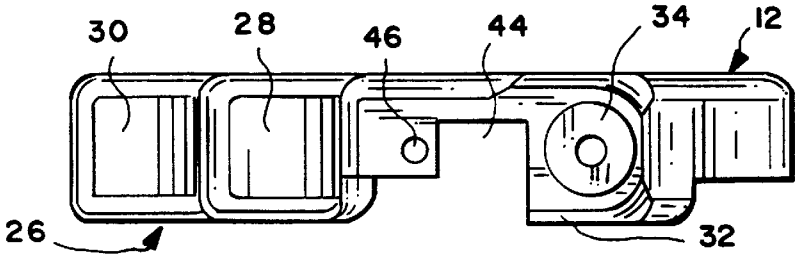
Fig. 4

BOWSTRING RELEASES

TECHNICAL FIELD

This invention relates to bowstring release devices particularly for use in competition archery.

BACKGROUND AND SUMMARY OF THE INVENTION

Various release devices are utilized in archery to assist the archer in pulling a bowstring to a fully drawn position and then releasing the bowstring to fire the arrow. Many of these devices include mechanical grippers which engage the bowstring directly, or which engage nock elements mounted on the bowstring. Other devices use rope looped about the bowstring as the release mechanism. Examples of such release devices may be found in my earlier U.S. Pat. Nos. 5,680,851 and 5,685,286, both of which are incorporated herein by reference. Additional examples are disclosed in my U.S. Pat. No. 5,803,068, also incorporated herein by reference.

There is a continuing demand, however, for even more sensitive and accurate release devices, particularly for competition archery where every advantage is sought by the archer.

This invention relates to improved release devices which utilize essentially non-moving, pressure sensitive triggers, and which also eliminate torque on the bowstring as well as on the jaws of the release device. Other features and advantages will be discussed further herein.

In one exemplary embodiment, the release includes a handle body which supports gripping jaws within a jaw release housing (which may be similar to that disclosed in the above identified '286 patent), a combined cocking/hammer bar, a trigger and a connector for attachment to a wrist strap or the like. The cocking/hammer bar is pivotally mounted within the handle body, with a hammer head at one end in alignment with a jaw release firing pin, and a cocking trigger at the opposite end, extending outside and to the rear of the handle body.

The firing trigger mechanism is also pivotally mounted within the body, with a firing trigger also extending outside but forward of the handle body (for engagement with the index finger), and an opposite actuator end generally adjacent the hammer head of the combined cocking/hammer bar. Interposed between the trigger actuator end and the hammer head is a roller sear, rotatably mounted within a generally Z-shaped housing or crank, also pivotally secured within the handle body.

In an uncocked position, the cocking/hammer bar is spring biased to a release or firing position, with the head having pushed the firing pin to its forwardmost release position. At the same time, the Z-shaped crank is biased in a cocking direction, but out of engagement with the hammer head. The trigger mechanism in this uncocked position is biased toward a non-firing mode, recognizing, however, that there is essentially no perceptible trigger movement when firing.

To cock the release, the cocking trigger is pulled rearwardly against its normal spring bias, such that the hammer head rides over the roller sear as the Z-shaped crank is forced simultaneously to rotate away from the hammer head. Once over the roller sear, the hammer head moves into a recess in the sear housing or crank as the latter rotates in an opposite direction under its own normal spring bias, the roller capturing the hammer head in the cocked position.

With extended leverage built into the firing trigger mechanism, only slight pressure need be exerted on the firing trigger to cause the opposite end of the trigger mechanism (which is in engagement with one end of the crank) to pivot the crank just sufficient to permit the hammer head to again ride over the roller sear, escaping the roller sear housing and driving the firing pin forward under the influence of the cocking/hammer bar springs.

It should be noted that in the cocked position, a very slight clearance is maintained between the firing pin and the hammer head, so that there is no load on the firing pin at any time prior to firing.

The release as described also incorporates a trigger sensitivity adjustment between the actuator end of the firing trigger and the sear housing, and a trigger "travel" adjustment between the handle body and the firing trigger mechanism. A noise suppression spring is also provided between the handle body and the cocking/hammer bar at a location adjacent the hammer head.

Another feature of the invention relates to the use of a bronze bushing through which the firing pin slides. This bushing prevents firing pin wear on the softer aluminum handle body.

The remote end of the release handle body supports a disk-like link pin, rotatable about its own axis, and which supports a screw connector extending rearwardly of the handle for attachment to a wrist strap connector. The wrist strap and connector assembly is the subject of a separate co-pending application concurrently filed with this application and entitled "Wrist Strap Connector For A Bowstring Release", In another embodiment of the invention, the otherwise solid aluminum handle body has a rearwardly opening slot in which the cocking/hammer bar, trigger mechanism, firing pin and sear housing are located. In this arrangement, the firing trigger extends rearwardly of the handle body for engagement by the user's thumb. The cocking trigger of the cocking/hammer bar also extends rearwardly out of the slot in the handle body, but sufficiently remote from the firing trigger to avoid interference. This second embodiment also omits the wrist strap connector as described above. The jaws and jaw release housing in this second embodiment may be disclosed in my above-identified co-pending '038 application.

In both of the exemplary embodiments, the fundamental relationship between the firing trigger, cocking/hammer bar, firing pin, Z-shaped sear housing and sear roller is essentially identical, even though certain components have different shapes while others are identical. In both embodiments, the jaw housing is rotatable relative to the handle body and, in the first described embodiment, the handle body is also rotatable (about two mutually perpendicular axes) relative to the wrist strap thereby reducing if not completely eliminating torque on the bowstring and/or release jaws. Moreover, the "non-moving" trigger mechanism and load free firing pin provide for even greater sensitivity and accuracy.

In its broader aspects, therefore, the present invention relates to a bowstring release comprising a handle body, said handle body supporting a jaw release housing and associated jaws actuable by means of a firing pin extending into an interior portion of the handle body; a hammer bar including a hammer head engagable with the firing pin and movable to a cocked position by means of a cocking trigger portion of the hammer bar, the cocking trigger extending outside the handle body; a firing trigger assembly including a firing trigger outside the handle body and a trigger actuating arm located within the handle body; and a roller sear housing and roller sear assembly, the housing having one end engageable with the trigger actuating arm, and the roller engageable with the hammer head; wherein the hammer head is seated in the roller sear housing in a cocked position, and wherein pressure applied to the firing trigger causes the roller sear housing to release the hammer head for firing engagement with the firing pin.

In another aspect, the invention relates to a bowstring release comprising a handle body, said handle body supporting a jaw release housing and associated jaws actuable by means of a firing pin extending into an interior portion of the handle body; a hammer bar including a hammer head engagable with said firing pin and movable to a cocked position by means of a cocking trigger portion of said hammer bar, said cocking trigger extending outside said handle body; a firing trigger assembly including a firing trigger outside said handle body and a trigger actuating arm located within said handle body; and a roller sear housing and roller sear assembly, said housing having one end engageable with said trigger actuating arm, and said roller engageable with said hammer head; wherein said hammer head is seated in said roller sear housing in a cocked position, and wherein pressure applied to said firing trigger causes said roller sear housing to release said hammer head for firing engagement with said firing pin.

Other objects and advantages will become apparent from the detailed description which follows.

BRIEF DESCRIPTION OF THE DRAWINGS

FIG. 3 is side elevation of the handle body of the bowstring release, with the internal component parts removed;

FIG. 4 is a top plan view of the handle body shown in FIG. 3;

FIG. 5 a front elevation of the handle body shown in FIG. 3;

DETAILED DESCRIPTION OF THE DRAWINGS

Figure 1:
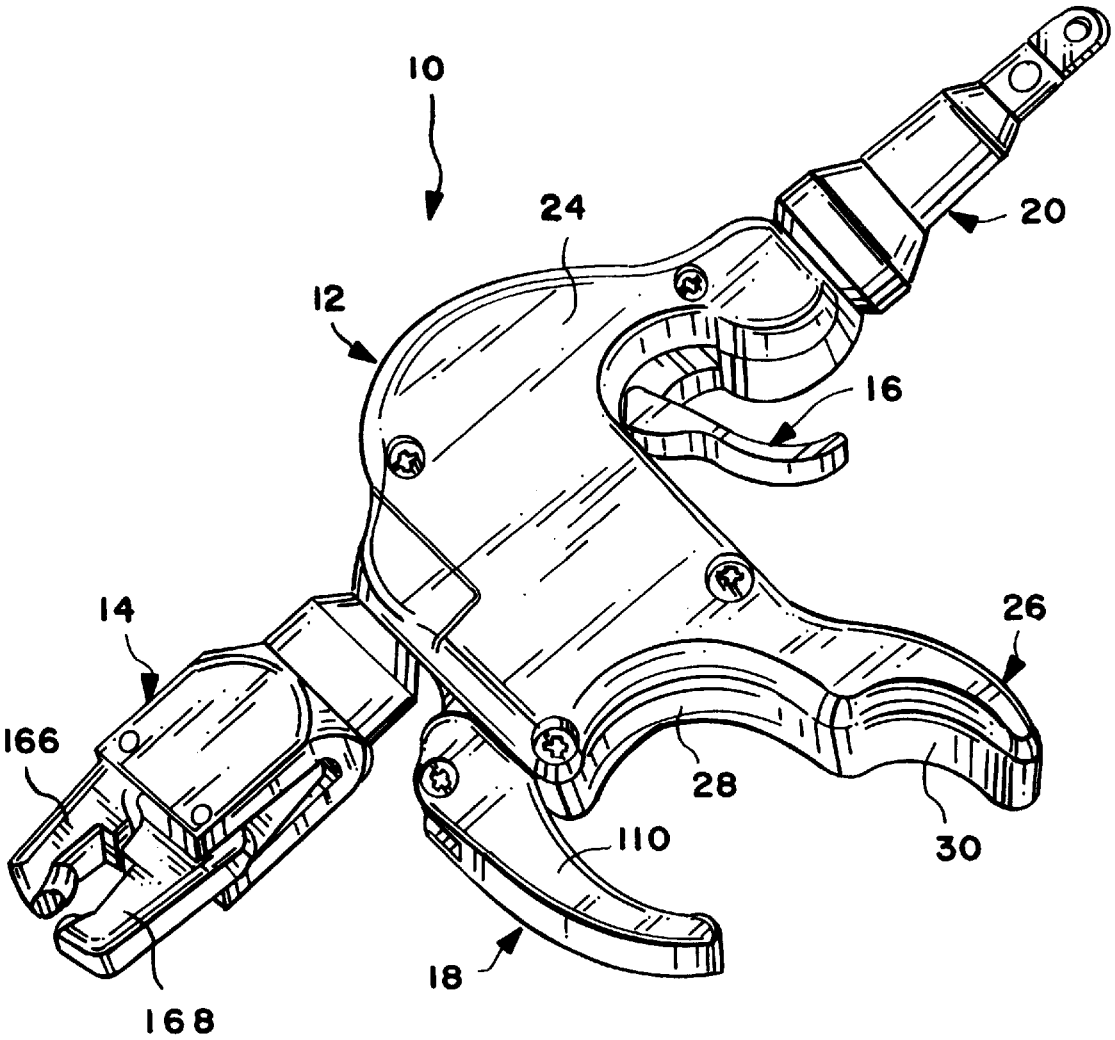
FIG. 1 is a perspective view of a bowstring release in accordance with a first exemplary embodiment of the invention.

The release 10 includes a handle body 12 which serves as a hand grip. The latter supports a jaw assembly 14 at a forward side thereof. The handle body also supports a combined cocking and hammer bar 16, a firing trigger mechanism 18 and a connector 20 for a wrist strap. Each of these major components as well as the handle body itself, will be discussed in detail below.

With reference especially to FIGS. 3–7, the handle body 12 is a solid aluminum block formed with an interior recess 22 which encloses and supports the working components of the release. A relatively flat cap 24 (FIGS. 1 and 6–8) is secured over the open areas of the body 12 as explained further below. The body 12 also includes a finger grip portion 26, with two finger grooves 28, 30 shown. The number of finger grooves, however, may be varied as desired.

Along a forward edge 32 of the handle body, there is an annular disk-like mounting flange or post 34, about which the jaw housing is secured (as described in detail in the '286 patent) such that the jaw and jaw housing assembly is rotatable about the post and relative to the handle body.

Figure 20:
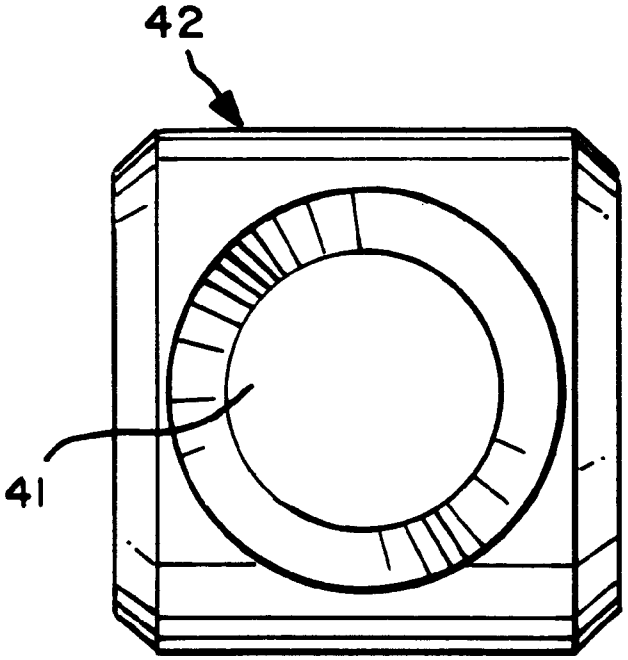
FIG. 20 is a side elevation of the bushing shown in FIG. 19.

A bore 36 extends through the flange 34, and through a relatively thick boss 38 into the interior of the handle body. Bore 36 slidably receives a firing pin 39 which extends into the jaw assembly 14. As already noted, the jaw assembly may be as described in the '286 patent, with firing pin 39 engageable with a ball actuator in the jaw housing. It will be appreciated, however, that the invention here is not limited to use with this specific jaw mechanism. Transversely of the bore 36, there is a cylindrical recess 40 adapted to receive a bronze bushing 42 (see FIGS. 2, 19 and 20), drilled at 41 to receive the firing pin 39. In this way, any sideways loading on the firing pin is taken up by the bronze bushing 42, and not by the softer aluminum material from which the handle body is made.

A slot 44 opens along the forward edge 32, adjacent flange 34, from which the firing trigger 18 projects as described later in more detail. Adjacent the slot 44, there is a threaded bore 46 extending parallel to the firing pin 39 and also opening along the forward edge 32. A set screw 48 (FIG. 2) may be threaded into the bore 46 for a reason explained further herein. A slot 50 opens rearwardly along the rearward edge 52 of the handle body, allowing the cocking trigger 54 of the cocking/hammer bar 16 to project rearwardly through the slot and thus provide easy access by the user.

Also within the interior recess 22 are a pair of cocking/hammer bar spring receiving recesses 56, 58, while yet another spring receiving recess 60 is located adjacent the cylindrical recess 40 For the bronze bushing 42.

A curved extension 62 of the handle body projects rearwardly for attachment to a wrist strap. Thus, a round recess 64 is adapted to receive a similarly shaped, disk-like link pin 66 (see FIG. 2) which is itself bored and counterbored to receive the head of a screw fastener 68 (or similar) which may be threaded into the wrist strap connector 20 and locked in place by a set screw 70. The screw fastener thus remains rotatable within and relative to the link pin and to the release.

Figure 7:
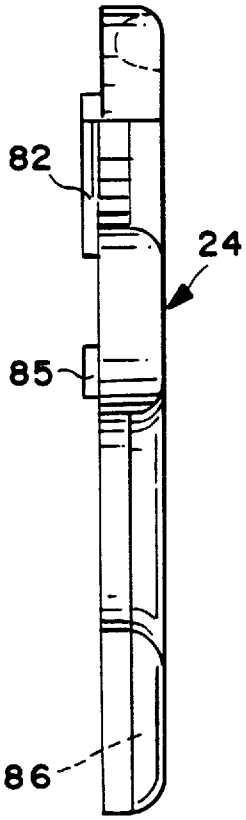
FIG. 7 is a side elevation of the cap shown in FIG. 6.
Figure 6:
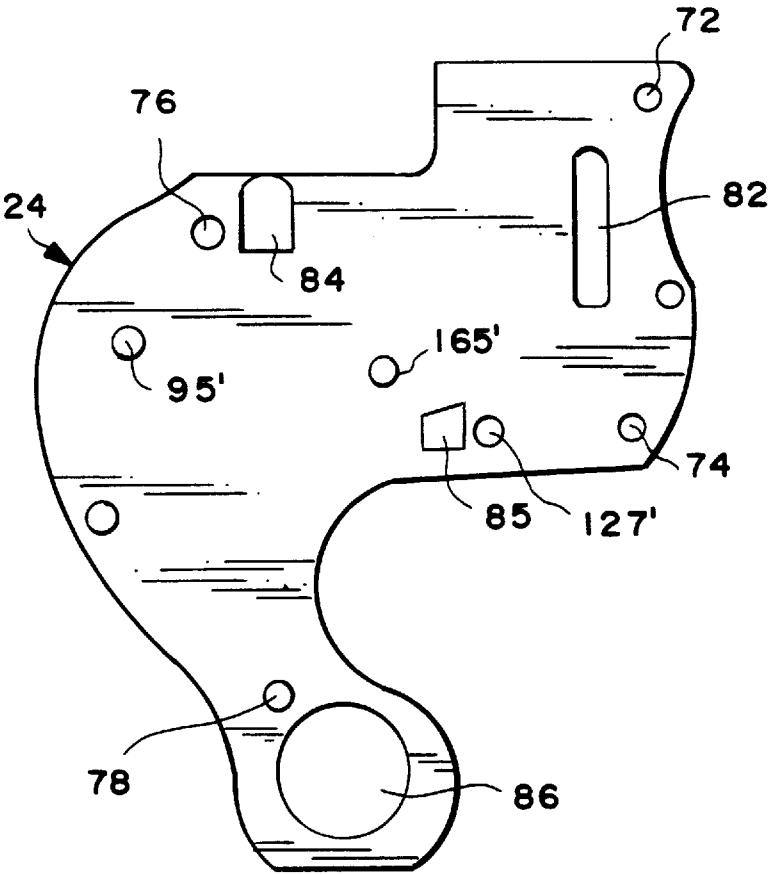
FIG. 6 is an interior plan view of handle body cap removed from the bowstring release mechanism of FIG. 1.
Figure 8:
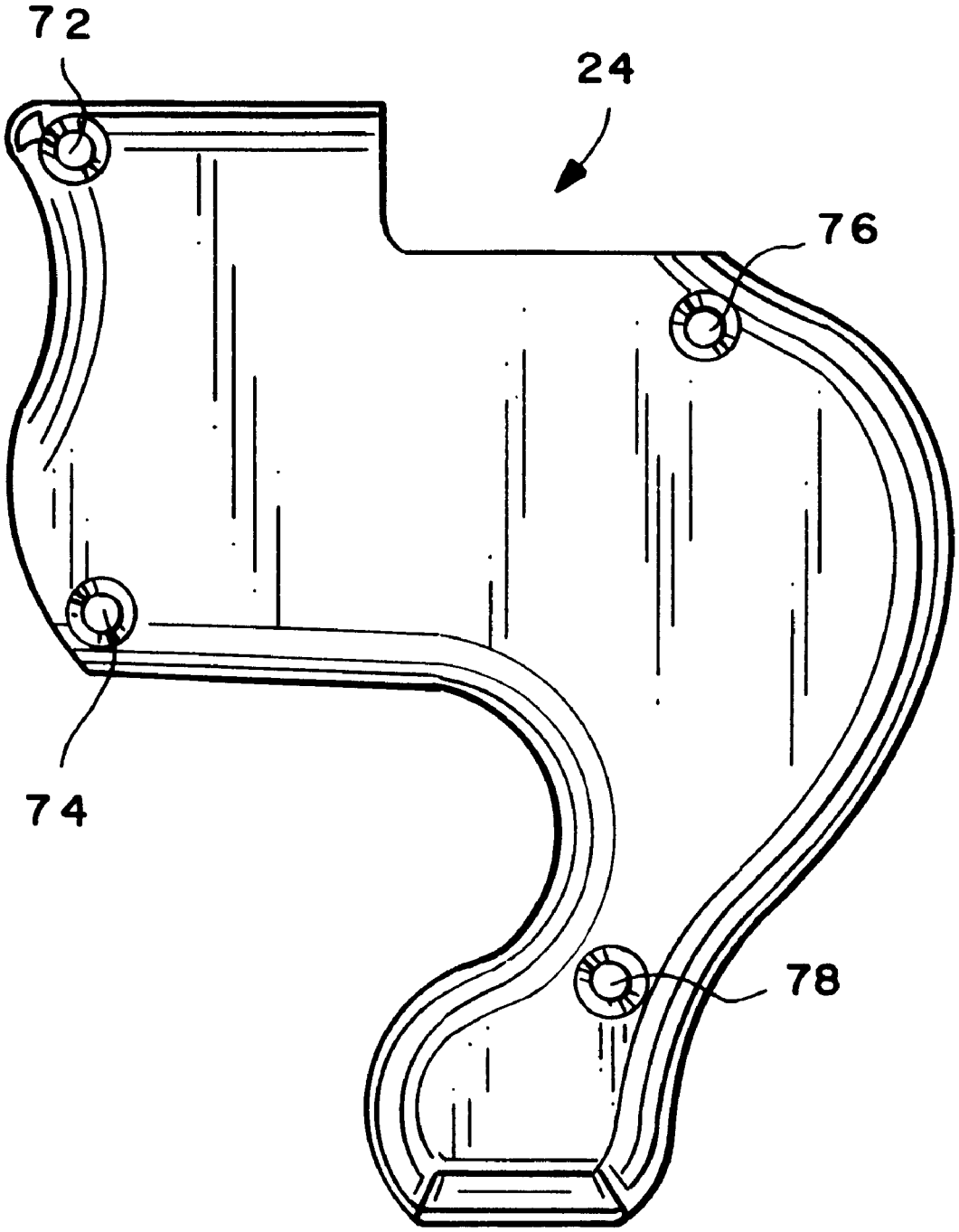
FIG. 8 is an exterior plan view of the bowstring release cap used in the assembly shown in FIG. 1.

With reference especially to FIGS. 6–8, the cap 24 is shaped and designed for attachment to the body by screws at four attachment hole locations 72, 74, 76, 78. The cap is configured to cover all but the grip portion 26, leaving open the forward and rearward slots 44, 50, respectively. The cap is also formed with internal bosses 82, 84 and 85, the purpose of which will be described further herein. A recess 86 conforms and partially encloses the link pin 66.

Figure 2:
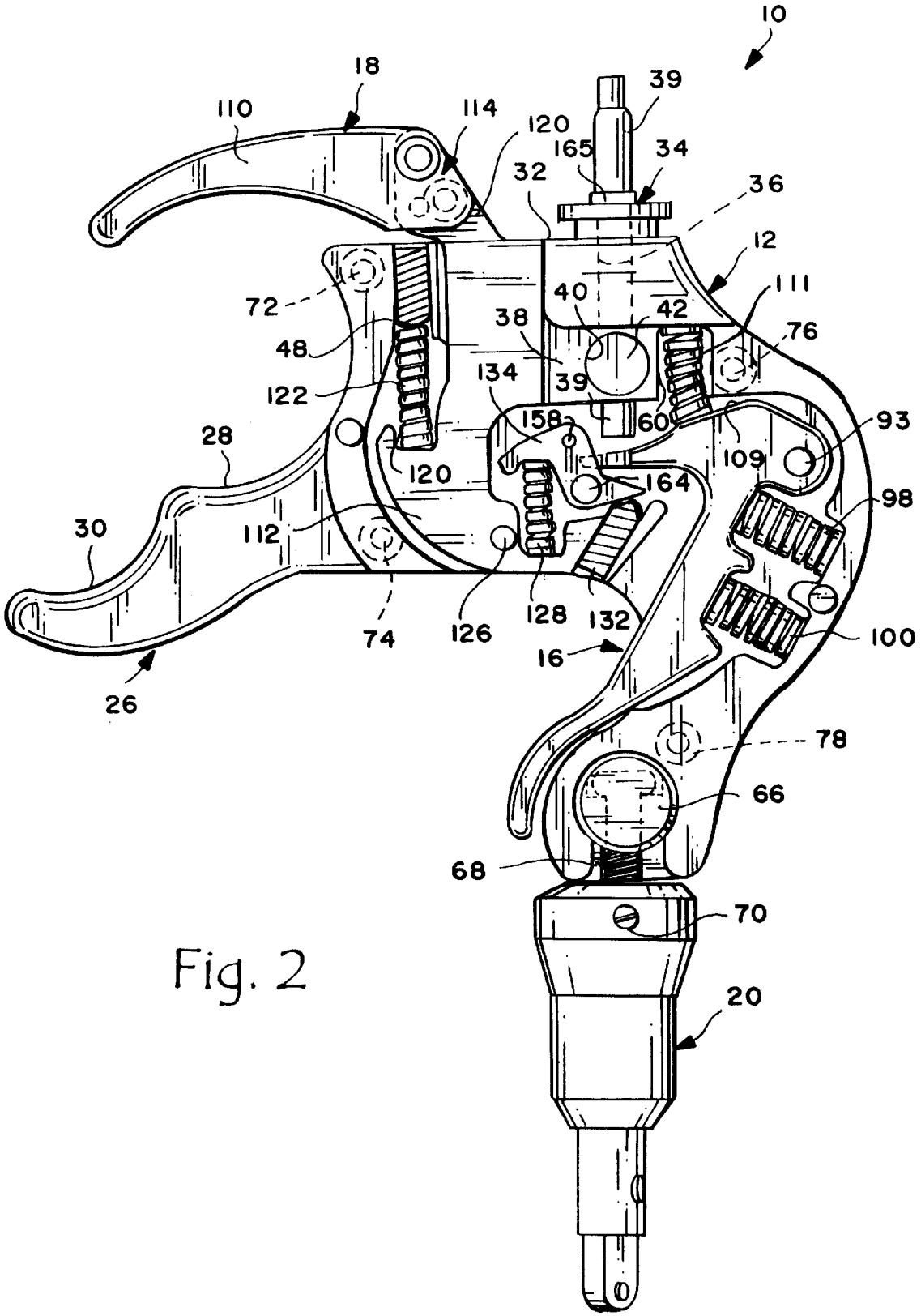
FIG. 2 is a side elevation of the bowstring release shown in FIG. 1, but with a handle body cap and jaw release mechanism removed for simplicity.
Figure 10:
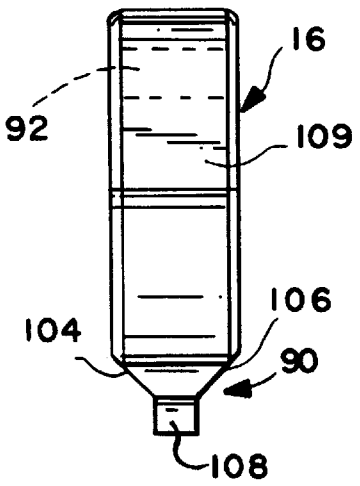
FIG. 10 is a left side elevation of the cocking/hammer bar shown in FIG. 9.
Figure 9:
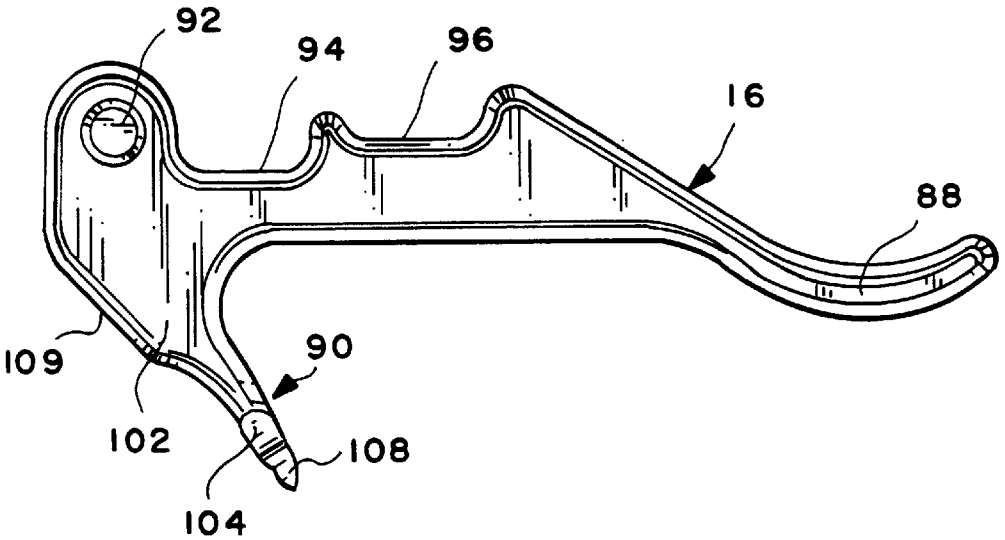
FIG. 9 is an enlarged plan view of a cocking/hammer bar incorporated in the assembly shown in FIG. 2.
Figure 12:
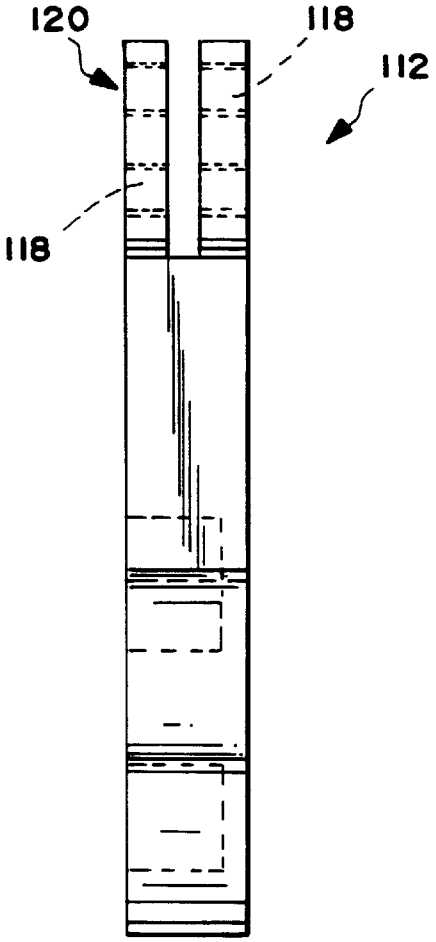
FIG. 12 is a right side elevation of the actuating arm shown in FIG. 11.

Turning now to FIGS. 9 and 10, the cocking/hammer bar (also referred to simply as the hammer bar) 16 is an elongated member having a cocking trigger 88 at one end thereof, and a hammer head 90 at an opposite end thereof. A pivot pin hole 92 is located above and forward of the head 90 (as viewed in FIG. 9). Between the pivot pin hole 92 and the cocking trigger 88, there are a pair of adjacent recesses 94, 96 which align generally with recesses 56, 58 in the interior of the handle body, so that a pair of coil springs 98, 100 can be seated within the respective pairs of recesses, as shown in FIG. 2. Note in the latter Figure that hammer bar 16 is secured within the recess 22 by a dowel (pivot) pin 93 press fit in hole 92 and aligned recesses 95, 95' in the handle body and cap, respectively. The hammer bar 16 includes a head extension 102 which downwardly and rearwardly relative to pivot hole 92, terminating at the hammer head 90. The latter includes a pair of tapered shoulders 104, 106 best seen in FIG. 10, from which a narrow tip 108 projects. A flat surface 109 adjacent the head 90 provides an engagement point for a spring 111 extending between the recess 60 in the handle body and the hammer bar 16 (see FIG. 2).

Figure 14:
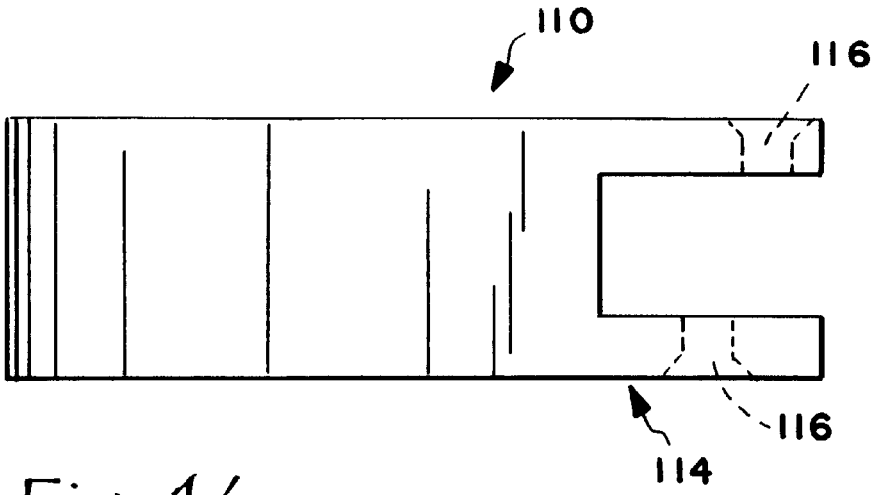
FIG. 14 is a bottom plan view of the firing trigger shown in FIG. 13.
Figure 13:
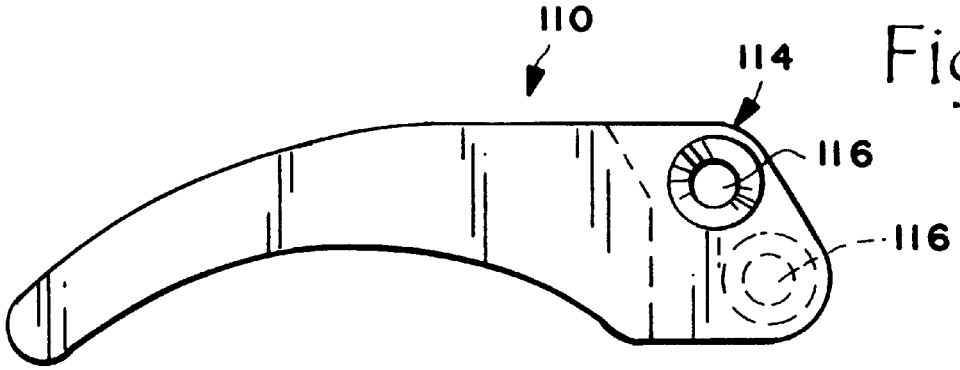
FIG. 13 is an enlarged plan view of the firing trigger taken from the assembly shown in FIG. 2.

The trigger mechanism is illustrated in FIGS. 1–14. Specifically, the trigger mechanism 18 is a two-piece assembly including the firing trigger 110 (FIGS. 13, 14) and the trigger actuating arm 112. The firing trigger 110 has a forked end 114 including offset mounting holes 1 16. The forked end 114 is adapted for interengagement with the forked end 120 of the actuating arm 112. End 120 is formed with three pair of aligned mounting holes 118. It will thus be appreciated that trigger 110 may be fixed to the actuating arm 112 at any of a variety of angles as desired by the archer, by selecting one of the holes 116 for alignment with one of the pair of holes 118 and using a suitable screw to fix the trigger 110 to the arm 112.

Figure 11:
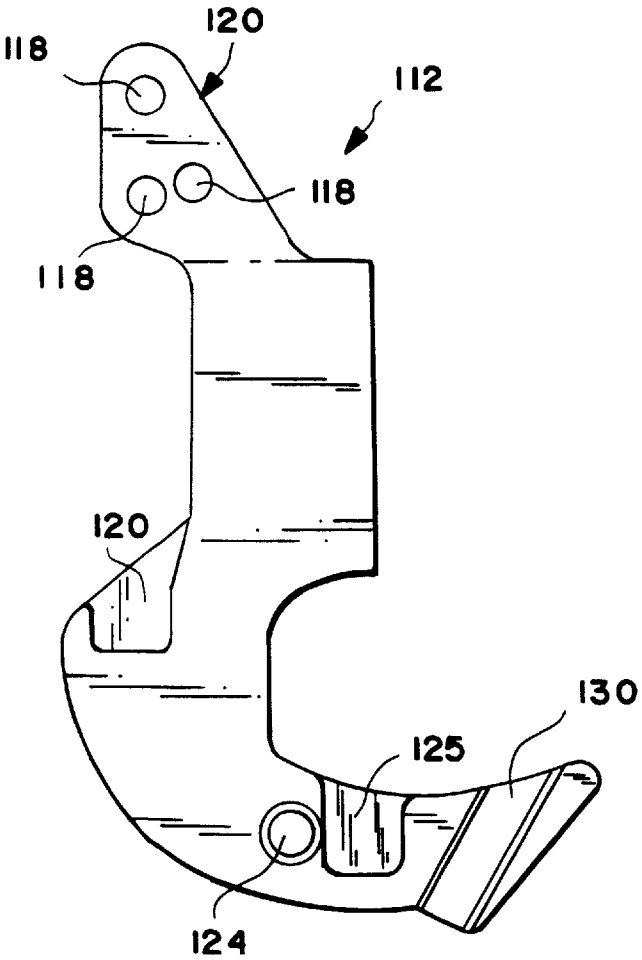
FIG. 11 is an enlarged plan view of a trigger actuating arm taken from the internal assembly shown in FIG. 2.

As viewed in FIG. 11, the trigger actuating arm 112 is generally in the shape of a stylized "L", with the forked end 120 at the upper end of the vertical stem of the L. Near the interface of the stern and base of the L, there is provided a recess 120 which is designed to receive one end of a coil spring 122 (see FIG. 2) extending between the recess and the set screw 48 in the bore 46 of the handle body. Approximately midway along the base of the L, there is a pivot hole 124 by which the trigger mechanism is pivotally mounted in the handle body via dowel pin 126 (see FIG. 2) seated in recesses 127, 127' in the handle body and cap, respectively. Immediately adjacent the pivot hole 124, there is an upwardly opening recess 125 adapted to receive a coil spring 128 (FIG. 2). At the distal end of the base of the L, there is an angled, threaded bore 130 adapted to receive a set screw 132 (FIG. 2).

As best seen in FIG. 2, when the trigger mechanism is pivotally mounted within the handle body, the forked ends 114, 120 of the trigger 110 and actuating arm 112, respectively, are located outside the handle body to permit easy access for re-adjustment of the trigger relative to the actuating arm. At the same time, the base of the L-shaped actuating arm is accessible from the open slot 50 between the handle body 12 and cap 24, also permitting ready access to the set screw 132 used to adjust the trigger travel sensitivity.

Figure 15:
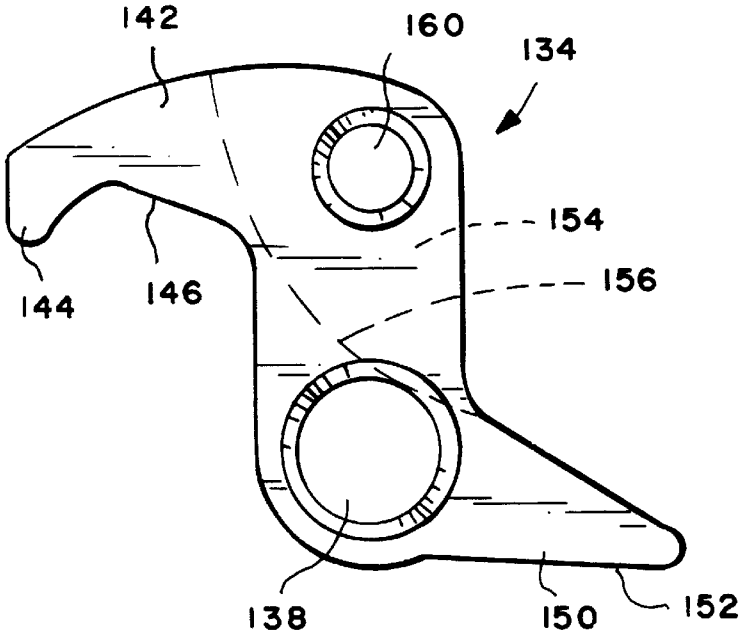
FIG. 15 is an enlarged plan view of a roller sear housing taken from the assembly shown in FIG. 2.
Figure 18:
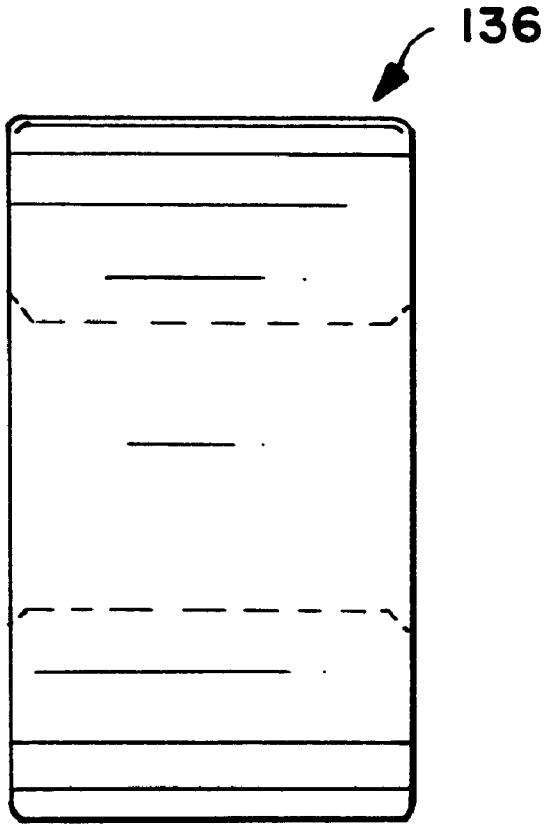
FIG. 18 is a side elevation of the roller shown in FIG. 17.
Figure 17:
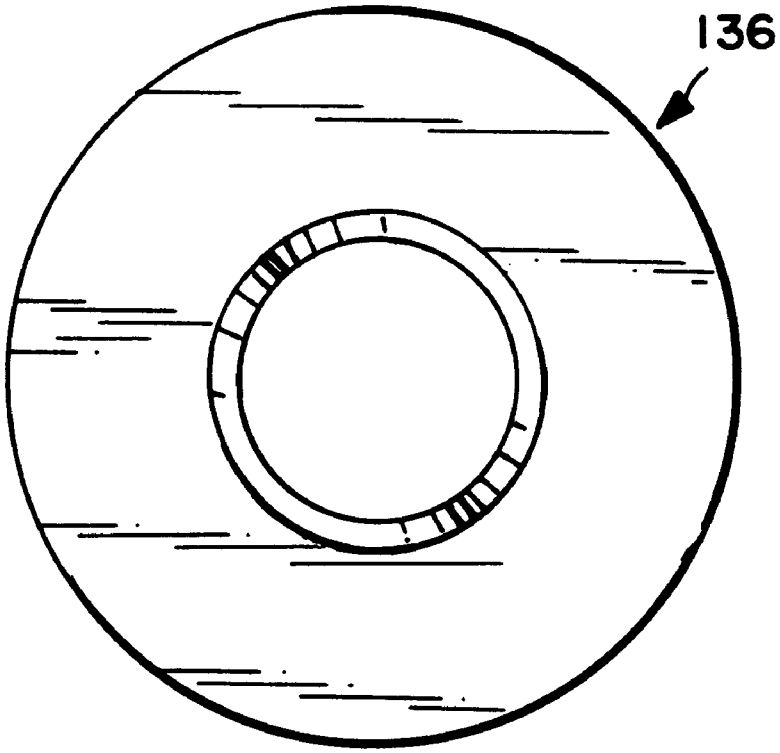
FIG. 17 is an enlarged plan view of a sear roller located within the roller sear housing taken from the assembly shown in FIG. 2.
Figure 19:
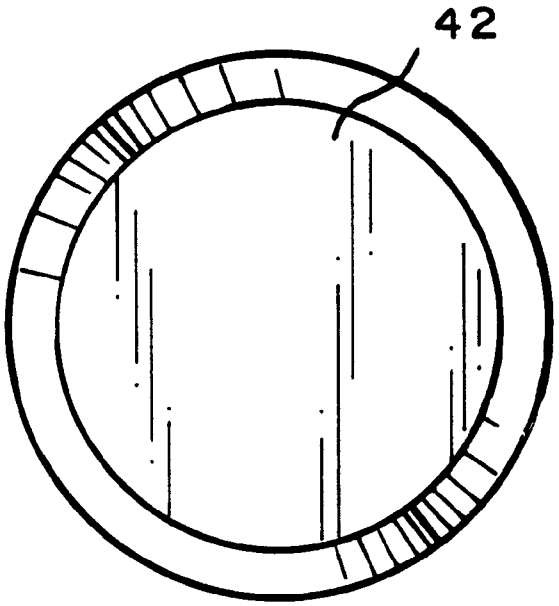
FIG. 19 is an enlarged plan view of a bronze bushing taken from the assembly shown in FIG. 2.

With reference now to FIGS. 15–18, a roller sear assembly includes a roller sear housing or crank 134 (FIGS. 15, 16) and roller sear 136 (FIGS. 18, 19). The housing 134, as best seen in FIGS. 2 and 15, has a generally Z-shape with a pivot mounting hole at 138. The housing thus acts as a crank with a first crank arm 142 offset from the pivot hole 138, the arm terminating at a downturned tip 144, creating a recess 146 which is adapted to receive the other end of coil spring 128 (FIG. 2). A second crank arm 150 extends from pivot hole 138 in an opposite direction from crank 142, and includes a lower surface 152 which is engaged by the set screw 132 (see FIG. 2).

Figure 16:
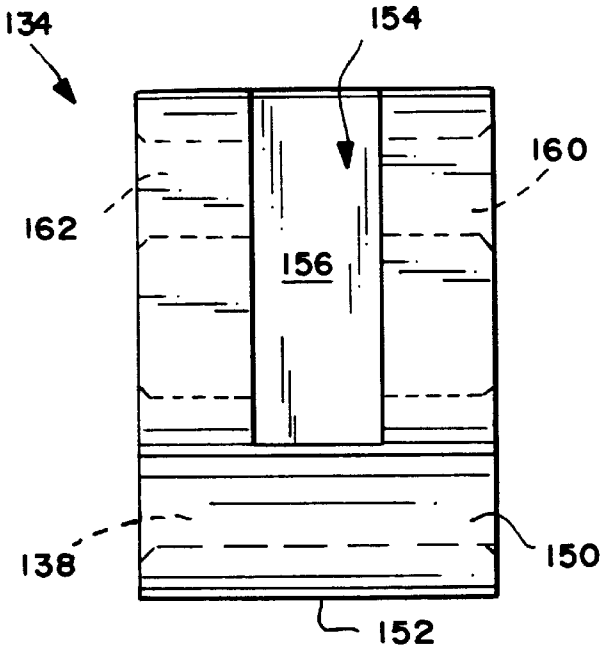
FIG. 16 is a right side elevation of the housing shown in FIG. 15.

A curved recess 154 is formed in the housing, opening along the right edge as viewed in FIG. 16, and also open partially along the top edge. The base of the recess is shown at 156. This recess permits the mounting of the roller sear 136 (FIGS. 17 and 18) by means of an axle or pin 158 (FIG. 2) press fit into aligned holes 160, 162 (FIG. 17) on either side of the recess. The roller sear itself is freely rotatable on the axle or pin 158 and is preferably made of hardened A-2 tool steel (52–58 Rockwell C), with a nickel plate coating.

As seen in FIG. 2, the roller sear housing or crank is pivotally mounted within the handle body by a dowel pin 164 seated in recesses 165, 165' in the handle body and cap, respectively. The roller sear housing is interposed between the trigger actuating arm 112 and the hammer bar 16, noting that recess 154 is sufficiently large to receive the tip 108 of the hammer head 90 in the cocked position as shown in FIG. 2 and as described further below.

With reference again to FIGS. 1, 2 and 6, when the cap 24 is secured to the handle body by screws inserted through the holes 72, 74, 76 and 78, the internal bosses 82, 84 and 85 hold the springs 128, 111 and 122, respectively, in proper lateral alignment within the handle body.

With particular reference to FIG. 2, and with the hammer bar 16 in the in an uncocked position (not shown), the hammer bar springs 98, 100 bias the hammer bar 16 in a clockwise direction about pivot pin 93, so that the hammer head 90 is engaged with the firing pin 18, biasing the latter forward to a release position. Noise suppression spring 111 biases the hammer bar in an opposite, counterclockwise direction about pin 93, but this spring is considerably weaker than springs 98,1 00. At the same time, trigger spring 128 biases the Z-shaped housing 134 in a clockwise direction about pivot pin 164 to a stop limit in the form of trigger travel sensitivity screw 132. The opposite end of the trigger spring 128 bears on the trigger actuating arm 112 within recess 125, such that arm 134 of the roller housing and trigger spring 128 bias the firing trigger actuating arm 112 in a clockwise direction about the pin 126.

To effect the cocking of the hammer bar 16, the latter is pressed in a counter-clockwise direction, toward the remote end of the handle, about the pivot pin 93 to the position shown in FIG. 2. This rotational movement is opposed by the hammer bar springs 98 and 100, while minimally assisted by the noise suppression spring 111. As the head of the hammer pivots downwardly as viewed in FIG. 2, it engages sear roller 136, forcing the roller housing 134 to pivot in a counter-clockwise direction about pin 164, the motion opposed by trigger spring 128. As the housing rotates, the hammer head tip 108 rides over the roller 136 as the latter rotates, and moves into the recess 154 below the roller. Once in the recess 154, the trigger spring 128 pushes the roller housing 134 back in a clockwise direction, so that the roller moves over the head 90, capturing and locking the tip 108 of head 90 in the cocked position.

It should be noted further that, as the hammer bar rotates 16 in the counterclockwise direction, the jaw actuator spring (not shown) pushes the firing pin 39 rearwardly, but only to the extent permitted by collar 165 (FIG. 2), such that the firing pin 39 lies adjacent the hammer head 90 in the cocked position. In fact, there is about 0.050 inch clearance between the hammer head and the firing pin in the cocked position, so that there is no load in the firing pin at any time prior to firing.

To fire the release, the archer merely exerts minimum pressure on the highly leveraged firing trigger 110, causing the latter to pivot almost unperceptibly in a counter-clockwise direction about pin 126, which, in turn, causes set screw 132 to push arm 150 of the roller housing 134 in a counter-clockwise direction an amount just sufficient for the hammer head tip 108 to escape recess 154, riding over the roller 136 as the latter swings down. The head 90 then drives the firing pin 39 forwardly to release the jaws 166, 168.

There are adjustments which permit the sensitivity of the trigger to be altered to suit the archer's preference. For example, the set screw 48 in bore 46 bears on the spring 122 which, in turn is seated in the recess 120 in the trigger actuating arm 112, biasing the latter in a counter-clockwise direction about pin 126. Rotation of set screw 48 thus enables the archer to adjust the trigger travel within very small limits, given that the trigger travel is generally only about 0.004 inch. The set screw 132 threaded within the bore 130 at the remote end of the trigger actuating arm 112 bears on the surface 152 of the crank arm 150 of the roller housing 134. Adjustment of this screw lessens or heightens the sensitivity of the trigger.

At the remote end of the handle body 12, a transverse link pin 66 mounts a screw 68 for limited rotational movement about the link pin axis. The screw 68 is threaded into the generally cylindrical housing 20 which is also rotatable about the axis of the screw 68. As already noted, the connector 20 is the subject of my co-pending application 09-002863, filed concurrently herewith.

Another exemplary embodiment of the invention is illustrated in FIGS. 21–27. The handle body in this second exemplary embodiment has a different overall shape due to the relocation of the trigger mechanism from a location on the forward side of the handle body, to a location on the rearward side of the handle body. In addition, the handle body illustrated in FIGS. 21 and 27 does not have a connector for attachment to a wrist strap.

In this second embodiment, however, the fundamental relationship between the trigger mechanism, hammer bar and roller sear housing/roller assembly is identical.

Figure 21:
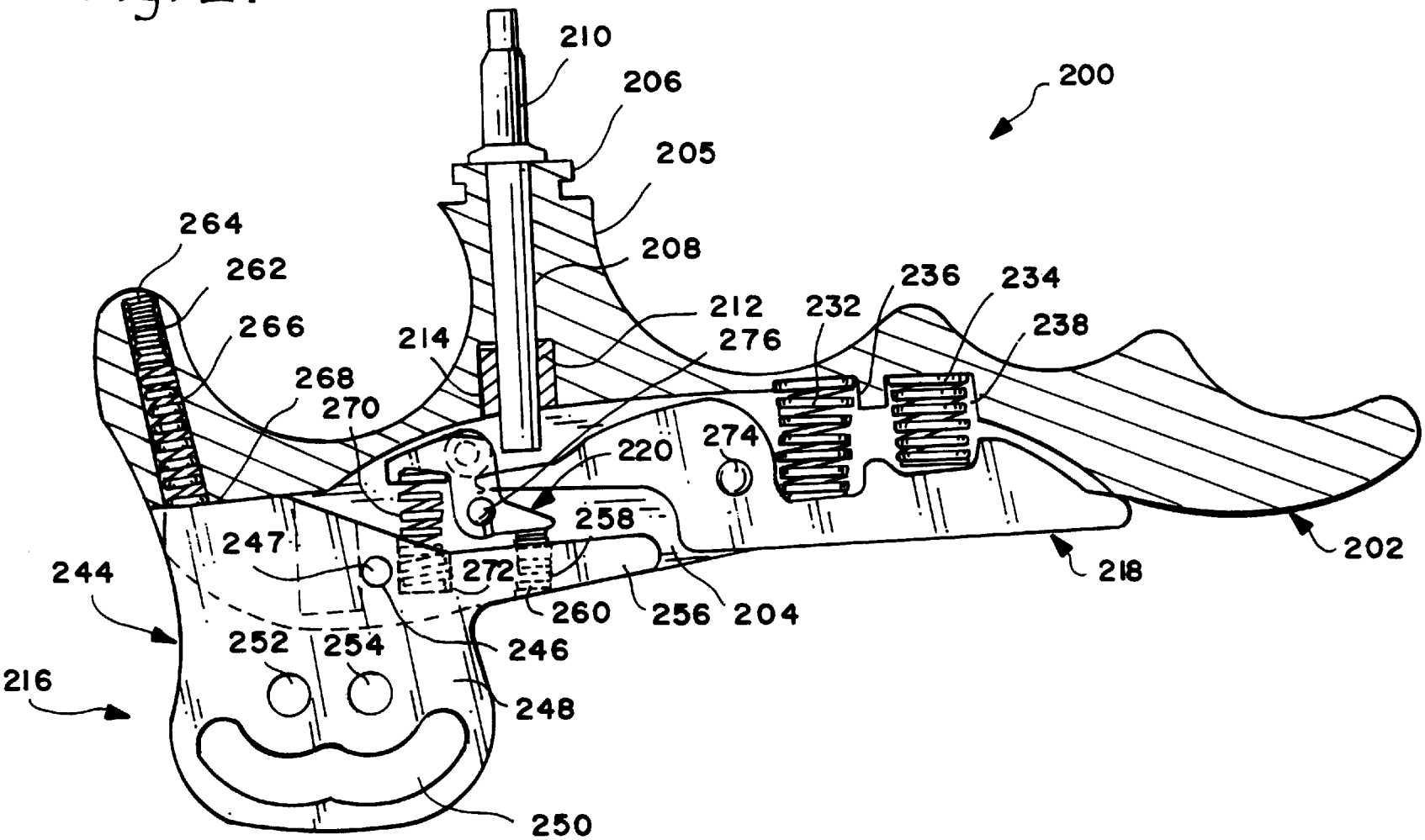
FIG. 21 is a side elevation, partly in section, of a release in accordance with a second exemplary embodiment of the invention.

With reference now to FIG. 21, the release 200 includes a handle body 202 comprised of a one-piece solid aluminum block machined to include a rearwardly opening recess or slot 204 in which the internal components are supported. The handle body is also formed with a forwardly projecting mounting flange or post 205 for rotatably supporting a jaw release housing and associated jaws similar to the first described embodiment. Here again, a disk-like mounting flange 206 permits the jaw housing to rotate relative to the handle body. This post portion of the handle body is also bored at 208 so that the firing pin 210 can extend from the jaw release housing (not shown) into the handle body 202. As in the previously described embodiment, a bronze bushing 212 is seated in a recess 214, and is bored to receive the pin 210, to thereby take up any sideways loading on the firing pin in a manner similar to the first described embodiment.

Within the rearwardly facing slot or recess formed in the handle body, a trigger assembly 216, hammer bar 218, and roller sear housing 220 are supported as described in greater detail below.

Figure 22:
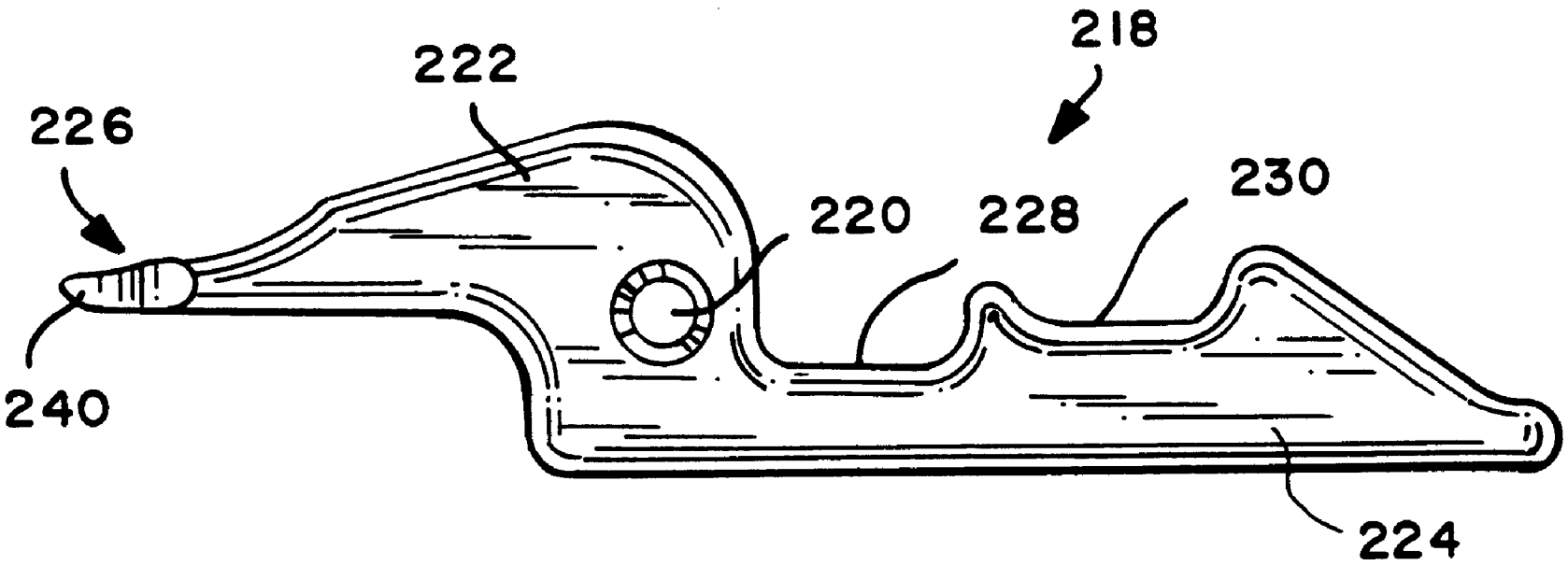
FIG. 22 is an enlarged side elevation of the hammer/cocking bar taken from FIG. 22.

The hammer bar 218 is best seen in FIG. 22 and, in this embodiment, also has a generally Z-shaped profile with a center pivot hole 220 located between the oppositely extending offset arms 222 and 224. The hammer head 226 is located at a distal end of the first arm 222, while the opposite end is formed with a pair of spring receiving recesses 228 and 230 which support first ends of a pair of coil springs 232 and 234 (see FIG. 22) extending between the hammer bar and aligned recesses 236, 238 in the handle body. The hammer head 226 has a profile identical to the hammer head utilized in the first described embodiment, including a narrow tip 240.

The firing assembly 216 includes a firing trigger 242 (FIGS. 23–27), adjustably attached to a trigger actuating arm 244, best seen in FIG. 21. The actuating arm 244 has a pivot hole 246 by which the actuating arm is pivotally mounted within the slot 204 in the handle body via pin 247. A rearwardly extending portion 248 of the actuating arm 244 is provided with a closed profile, multi-curved slot 250 and a pair of mounting holes 252 and 254 by which the firing trigger 242 may be adjustably attached to the actuating arm as described further below. A laterally extending finger 256 lies within the handle body and includes a threaded bore 258, perpendicularly oriented relative to the arm 244, for receiving a set screw 260 which engages the roller sear housing 220. The trigger mounting portion 248 of the actuating arm extends rearwardly outside the handle body for easy adjustment of the firing trigger by the user. A threaded bore 262 in the handle body is designed to receive a set screw 264 acting on a spring 266 which, in turn, bears on surface 268 of the arm 244. The spring 266 thus biases the trigger actuating arm 244 in a counter-clockwise direction about the pin 247.

The roller sear housing and roller assembly 220 in this second exemplary embodiment are identical to the roller sear housing and roller utilized in the first described embodiment. Thus, a coil spring 270 extends between roller sear housing and a recess 272 in the trigger actuating arm 244, while the set screw 260 is in adjustable engagement with the opposite end of the sear roller housing. It is significant that the pivot pins 247, 274 and 276 of the trigger mechanism, hammer bar and roller sear housing, respectively, are located identically, relative to each other, as the pivot pins 126, 93 and 164 in the earlier described embodiment so that, in operation, the release mechanism works in exactly the same manner. Note that, in this embodiment, the pivot pins are press fit within aligned holes in the handle body, on opposite sides of the slot 204.

Adjustments in this second embodiment are similar to those in the first described embodiment. Thus, set screw 264 engages the actuating arm 244 of the trigger assembly 216 for adjusting trigger travel. Also note that the pivot pin 247 for the trigger is closer to the set screw 260 so that sufficient leverage is obtained between the firing trigger and the lateral extension 256 of the actuating arm 244 so that only minimal pressure (and essentially no movement) is required in order to move the finger 256 of the actuating arm 244 the small amount necessary to pivot the roller sear housing, enabling the hammer head 226 to ride across the roller sear into firing engagement with the firing pin 210. Trigger sensitivity is adjustable via set screw 260.

Figure 24:
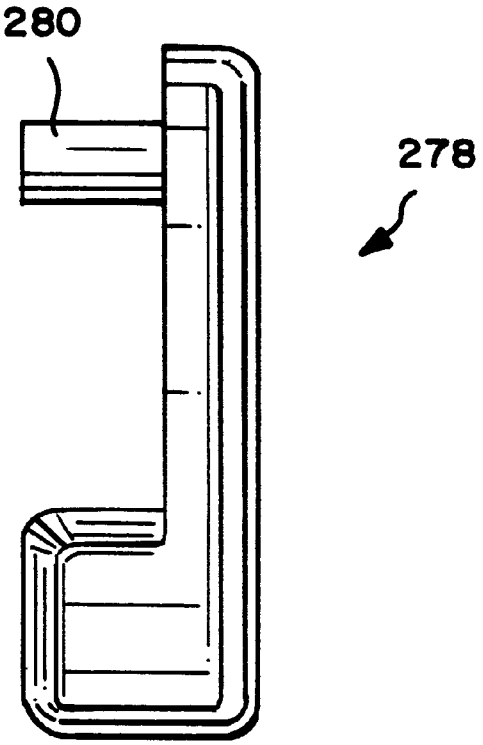
FIG. 24 is a end elevation of the trigger component shown in FIG. 23.
Figure 23:
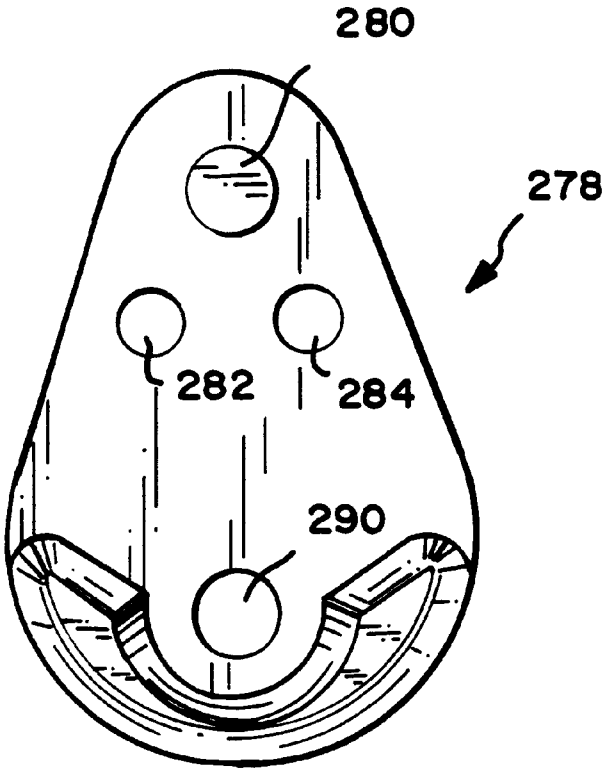
FIG. 23 is an enlarged side elevation of a firing trigger component for use with the release shown in FIG. 22.

FIGS. 23 and 24 illustrate a teardrop portion 278 of the firing trigger which is mounted to the trigger actuating arm 244 utilizing a pin 280 engageable within one of the holes 252, 254 on the actuating arm 244. A pair of threaded screw holes 282, 284 are located adjacent pin 280. Depending on which of the two holes 252, 254 receives the pin 280, one of the screw holes 282, 284 will align with one or the other sides of slot 250. A threaded fastener 286 can then be inserted through the slot 250 (from the back as viewed in FIGS. 21 and 27) and into the chosen one of the holes 252, 254. In this way, multiple adjustments are available for the trigger component 278 relative to the arm 244.

Figure 25:
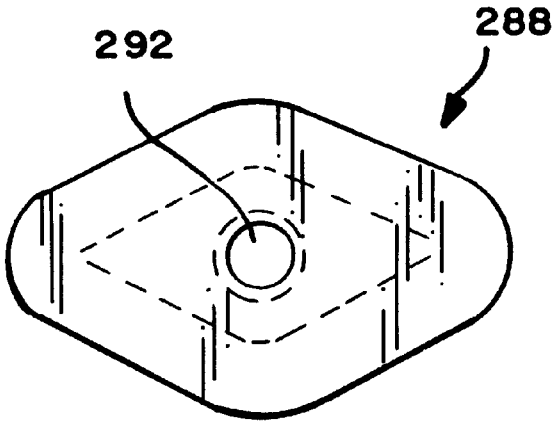
FIG. 25 is an enlarged plan view of a second firing trigger component for use with the release shown in FIG. 21.
Figure 26:
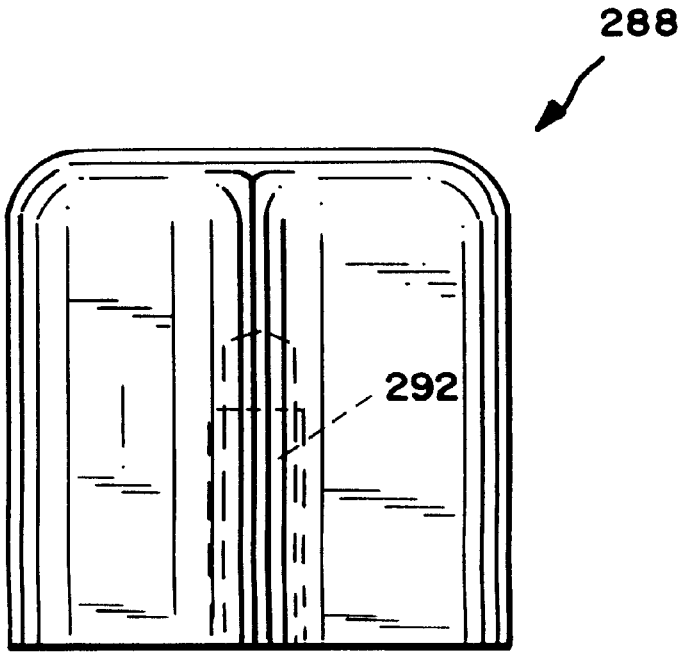
FIG. 26 is a top plan view of the trigger component shown in FIG. 25.
Figure 27:
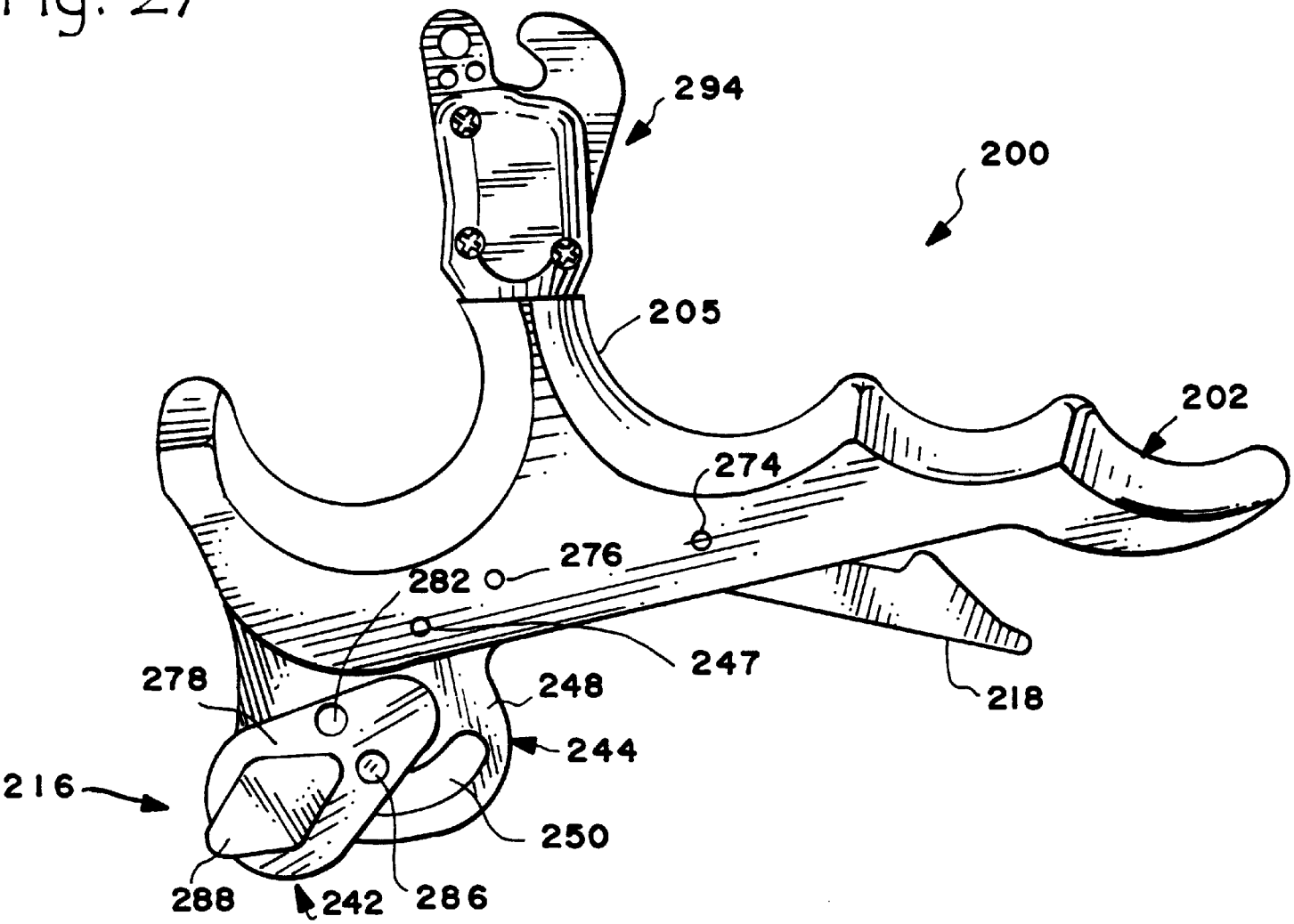
FIG. 27 is a perspective view of the assembled release shown in FIG. 22, with jaw assembly included.

The teardrop portion 278 serves as a mounting location for a diamond-shaped thumb grip 288 as shown in FIGS. 25–27. The grip may be fixedly mounted to the teardrop 278 to complete the custom fit of the handle body to the user, via a screw fastener (not shown) extending through hole 290 in the teardrop portion 278 and into a threaded hole 292 on the back side of the thumb grip. Note that the tear drop trigger component 278 and thumb grip 288 can be located on either side of the arm 244, further enhancing the flexibility of the device.

As already indicated above, the manner in which the hammer bar is cocked and fired in this second embodiment is essentially as described earlier in connection with the first embodiment, noting that the end of the hammer bar remote from the hammer head constitutes a cocking trigger which extends slightly beyond the slot in the handle body as best seen in FIG. 27 for easy access by the user.

FIG. 27 also illustrates the release device in combination with a relatively rotatable jaw assembly 294 configured for a rope release of the type disclosed in my U.S. Pat. No. 5,803,068, entitled "Back-Tension Rope Release." Other jaw assemblies may be used, however, in combination with the release body described herein.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bowstring release comprising a handle body, said handle body supporting:

a jaw release housing and associated jaws actuable by means of a firing pin extending into an interior portion of the handle body;

a hammer bar including a hammer head engagable with said firing pin and movable to a cocked position by means of a cocking trigger portion of said hammer bar, said cocking trigger extending outside said handle body;

a firing trigger assembly including a firing trigger outside said handle body and a trigger actuating arm located within said handle body; and a roller sear housing having one end engageable with said trigger actuating arm, said roller sear housing rotatable supporting a roller sear engageable with said hammer head;

wherein, when said hammer head is seated in said roller sear housing in a cocked position, pressure applied to said firing trigger causes said roller sear housing to release said hammer head for firing engagement with said firing pin.

2. The release of claim 1 wherein said handle body also supports a connector for attachment to a wrist strap.

3. The release of claim 2 wherein said connector is rotatable about two mutually perpendicular axes.

4. The release of claim 1 wherein said handle body includes one or more finger gripping grooves.

5. The release of claim 1 wherein said jaw release housing and associated jaws are supported on said handle body so as to be rotatable relatively thereto.

6. The release of claim 1 wherein said hammer bar, said firing trigger assembly and said roller sear housing are individually pivotally mounted within said handle body.

7. The release of claim 1 wherein one or more firing springs are interposed between the handle body and the hammer bar for biasing said hammer bar away from said cocked position.

8. The release of claim 7 wherein a first trigger spring is interposed between said roller sear housing and said trigger actuating arm for biasing said roller sear housing in a direction which maintains said hammer head within said roller sear housing in the cocked position.

9. The release of claim 8 wherein a second trigger spring is interposed between said handle body and said trigger actuating arm which biases said trigger actuating arm in a firing direction.

10. The release of claim 9 wherein said roller sear housing is generally Z-shaped with a first crank arm engaged with said first trigger spring and a second crank arm engaged with said trigger actuating arm.

11. The release of claim 10 including an adjustable set screw mounted in a distal end of said trigger actuating arm remote from said firing trigger, said set screw engaged with said second crank arm.

12. The release of claim 11 wherein said roller sear is mounted in a recess in said roller sear housing for rotation about an axle parallel to and offset from a pivot axis of said roller sear housing, said roller sear arranged such that said hammer head rides across said roller sear in one direction as it rotates to the cocked position, and rides across said roller sear in an opposite direction as it rotates to a firing position.

13. The release of claim 12 wherein, during cocking of the hammer bar, the hammer head causes said roller sear housing to rotate in one direction to allow said hammer head to ride over said roller sear, while during firing, the trigger actuating arm causes said roller sear housing to rotate in an opposite direction to allow said hammer head to escape said roller sear housing and to engage said firing pin.

14. The release of claim 1 wherein a bushing is seated within said handle body, said bushing having a bore through which said firing pin extends.

15. The release of claim 14 wherein said bushing is made of bronze and said handle body is made of aluminum.

16. The release of claim 1 wherein said firing trigger assembly is pivotally mounted in said handle body by a pivot pin located in close proximity to a distal end of said actuating arm, remote from said firing trigger such that only minimal pressure on said firing trigger is required to move said distal end of said actuating arm.

17. A bowstring release comprising a handle body, said handle body supporting;

a jaw release housing and associated jaws actuable by means of a firing pin extending into an interior portion of the handle body;

a hammer bar including a hammer head engagable with said firing pin and movable to a cocked position by means of a cocking trigger portion of said hammer bar, said cocking trigger extending outside said handle body;

a firing trigger assembly including a firing trigger outside said handle body and a trigger actuating arm located within said handle body; and a roller sear housing having one end engageable with said trigger actuating arm, said roller sear housing rotating supporting a roller sear engageable with said hammer head;

said firing trigger actuating arm pivotally mounted within said handle body at a location remote from said one end of said roller sear housing and proximate said firing trigger such that when said hammer head is seated in said roller sear housing and engaged with said roller sear in a cocked position, the bowstring release can be fired with substantially imperceptible movement of said firing trigger causing said roller sear housing and roller sear to release the hammer head for engagement with said firing pin.

18. The release of claim 17 wherein said jaw release housing and associated jaws are supported on said handle body so as to be rotatable relatively thereto.

19. The release of claim 17 wherein said handle body includes one or more finger gripping grooves.

20. The release of claim 17 wherein said hammer bar, said firing trigger assembly and said roller sear housing are individually pivotally mounted within said handle body.

21. The release of claim 17 wherein one or more firing springs are interposed between the handle body and the hammer bar for biasing said hammer bar away from said cocked position.

22. The release of claim 21 wherein a first trigger spring is interposed between said roller sear housing and said trigger actuating arm for biasing said roller sear housing in a direction which maintains said hammer head within said roller sear housing in the cocked position.

23. The release of claim 22 wherein a second trigger spring is interposed between said handle body and said trigger actuating arm which biases said trigger actuating arm in a firing direction.

24. The release of claim 22 wherein said roller sear housing is generally Z-shaped with a first crank arm engaged with said first trigger spring and a second crank arm engaged with said trigger actuating arm.

25. The release of claim 24 including an adjustable set screw mounted in a distal end of said trigger actuating arm remote from said firing trigger, said set screw engaged with said second crank arm.

26. The release of claim 25 wherein said roller sear is mounted in a recess in said roller sear housing for rotation about an axle parallel to and offset from a pivot axis of said roller sear housing, said roller sear arranged such that said hammer head rides across said roller sear in one direction as it rotates to the cocked position, and rides across said roller sear in an opposite direction as it rotates to a firing position.

27. The release of claim 26 wherein, during cocking of the hammer bar, the hammer head causes said roller sear housing to rotate in one direction to allow said hammer head to ride over said roller sear, while during firing, the trigger actuating arm causes said roller sear housing to rotate in an opposite direction to allow said hammer head to escape said roller sear housing and to engage said firing pin.

28. The release of claim 17 wherein a bushing is seated within said handle body, said bushing having a bore through which said firing pin extends.

29. The release of claim 28 wherein said bushing is made of bronze and said handle body is made of aluminum.

30. The release of claim 17 wherein said firing trigger assembly is pivotally mounted in said handle body by a pivot pin located in close proximity to a distal end of said actuating arm, remote from said firing trigger such that only minimal pressure on said firing trigger is required to move said distal end of said actuating arm.

* * * * *